United States Patent [19]

Kralick

[11] Patent Number: 4,573,320

[45] Date of Patent: Mar. 4, 1986

[54] COMBUSTION SYSTEM

[75] Inventor: James Kralick, Ballston Spa, N.Y.

[73] Assignee: Mechanical Technology Incorporated, Latham, N.Y.

[21] Appl. No.: 730,296

[22] Filed: May 3, 1985

[51] Int. Cl.[4] ..... F02G 1/04

[52] U.S. Cl. ..... 60/517

[58] Field of Search ..... 60/517, 524

[56] References Cited

U.S. PATENT DOCUMENTS 3,831,380 8/1974 Nederlof ..... 60/524
3,852,961 12/1974 Salomonsson et al. ..... 60/517
3,862,542 1/1975 Michels ..... 60/517
4,172,363 10/1979 Bex ..... 60/517
4,389,844 6/1983 Ackermann et al. ..... 60/517

*Primary Examiner*—Allen M. Ostrager
*Attorney, Agent, or Firm*—Joseph C. Sullivan; Joseph V. Claeys

[57] ABSTRACT

A ceramic liner for use in an external heat or combustion system for use with a Stirling engine and the like having a housing containing a heater space whereby the ceramic liner is disposed in the heater space and defines a combustion chamber within the liner mounted to the housing via a biasing arrangement so as to isolate the lining from vibrations in the housing.

12 Claims, 3 Drawing Figures

COMBUSTION SYSTEM

FIELD OF THE INVENTION

The present invention relates to an improvement in an external heat or combustion system which may be advantageously used with a Stirling engine through the incorporation of a ceramic liner around the combustion chamber.

BACKGROUND OF THE INVENTION

With the renewed and ever expanding interest in Stirling engines, efforts have been made to continually improve upon their efficiency. Basic Stirling engine principals of operations are set forth in a text entitled "Stirling Engines" by G. Walker, 1st Edition, 1980. Essentially, in this regard, a Stirling engine operates on the principal of heating and cooling a working fluid (gas), with the expansion and compression of the gas utilized to perform useful work. The engine may include a single or plurality of pistons and cylinders, depending upon the particular application and a variety of designs are illustrated in the aforenoted text with their attendant advantages.

As part of this improvement, ceramics have been incorporated in high temperature situations typical Stirling engines, particularly in the combustion area. For example, U.S. Pat. No. 3,862,542, issued Jan. 28, 1975, shows the use of a heat-insulating heater/burner jacket made out of a ceramic material in the burner/heater space of a hot-gas engine (Stirling). The stated purpose jacket is to contain the flame and to direct hot combustion products (gases) around the heater head for proper heat transfer to the working fluid. In U.S. Pat. No. 4,172,363, issued Oct. 30, 1979, a ceramic fiber mat is used to protect the cylinder head against the high flame temperature of the burner.

However, while such arrangements may be useful, the manner of installing the ceramic material has many drawbacks since it may be subject to damaging vibrations and expansion and contraction of adjacent members, which may occur in high temperature Stirling engine operation.

SUMMARY OF THE INVENTION

Accordingly, it is a principal object of the invention to provide a means mounting a ceramic liner in the combustion area of an external heat or combustion system which may be advantageously used with a Stirling engine which securely keeps it in place and, in addition, isolates the liner from harmful vibrations and movement which may occur in the structure to which it is attached.

In this regard, the present invention provides for a ceramic liner which defines the combustion chamber in the external heat or combustion system which is attached to its housing via a spring/bellow arrangement. The liner is positioned centrally within the heater or combustion housing defining a combustion area which may be located circumferentially around the heater head of a Sterling engine. The liner is coupled to the housing at the fuel nozzle via compression spring arrangement, two different arrangements of which are shown, along with bellows which provide sealing.

The spring arrangement isolates the liner from high frequency vibrations, yet securely maintain it in the desired location. In addition, the spring arrangement and bellows allow axial and thermal growth of the housing and/or liner to be adjusted for.

BRIEF DESCRIPTION OF THE DRAWINGS

Thus, by the present invention, its objects and advantages will be realized, the description of which should be taken in conjunction with the drawing, wherein.

DETAILED DESCRIPTION OF THE PREFERRED EMBODIMENT

Figure 1:
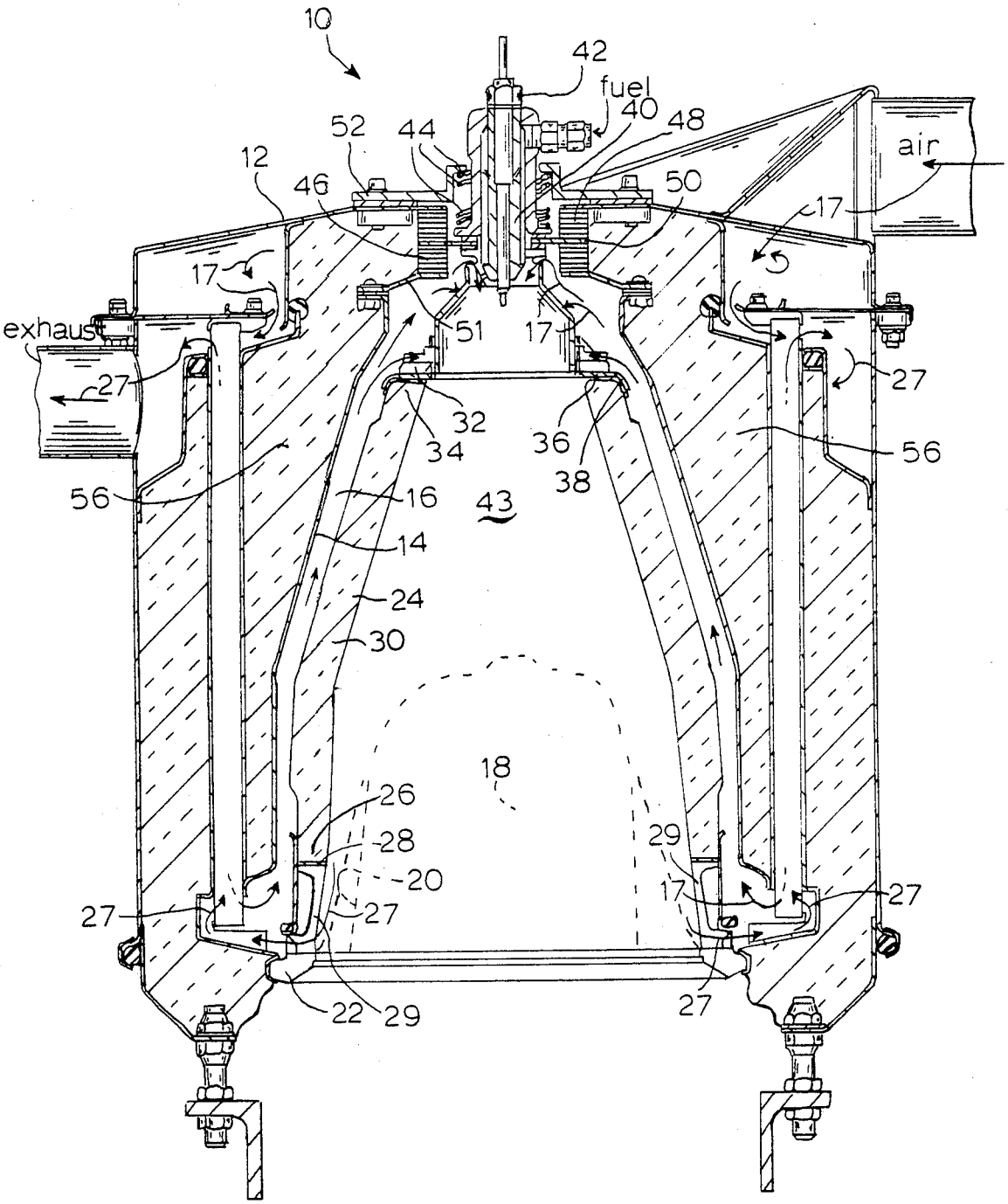
FIG. 1 is a partial sectional view of an external heat or combustion system for use, for example, with a Stirling engine, including a ceramic liner, incorporating the teachings of the present invention.

Turning now more particularly to FIG. 1, there is shown a sectional view of an external heat or combustion system housing 10 which may advantageously be used with a Stirling engine. (See, for example, Page 296 of the aforementioned text which illustrates an entire cross section of a single cylinder Stirling engine.) The housing includes a main structure 12 having an interior partition wall 14 defining an interior air flow passage 16 with the arrows 17 indicating incoming the air flow. The partition wall 14 may be made of perhaps metal, and is somewhat frustoconical in shape. Disposed within the partition wall 14 is a bucket-type pressure vessel comprising a cylindrical heater head 18 (partially shown in phantom). The interior of the heater head 18 would include an expansion space in which a displacer piston (not shown) reciprocates in typical Stirling operation. The heater head 18 includes external fins 20 about its periphery which taper outward from the top of the vessel downward to facilitate heat transfer from the combustion gas to the internal working gas. The fins 20 terminate at an annular lip or flange 22 positioned about the circumference of the heater head 18.

A ceramic liner 24 is provided which is a hollow and frustoconical in shape having an enlarged opening at its end or bottom 26. End 26 is of sufficient internal diameter to encircle the heater head 18 while having an external diameter sized to fit within the partition wall 14 to define the flow passage with exhaust gases exiting between the liner 22 and heater head 18 as shown by arrows 27. An annular compliant gasket 28 is interposed at end 26 between the liner 24 and support ring 29. The liner 24 is straight walled up until point 30 at which it tapers until it abutts cup member 32 at its opposite smaller open top end 34. A compliant gasket 36 is provided between flange 38 of cup member 32 and a portion of an external annular groove 40 about end 34.

Cup member 32 is part of the fuel nozzle 40 which includes an ignitor or spark plug 42. The fuel nozzle 40 serves to inject and ignite a combustible substance (air fuel) into combustion chamber 43. The nozzle 40 is coupled to the housing 12 by a compression spring 44 positioned about the nozzle 40. The compression spring 44 applies an axial force on the ceramic liner 24 through the fuel nozzle 40, cup 32 and gasket 36 which are soft mounted to the top of the liner 24, biasing it downward into gasket 28 and ring 29, positioning it circumferentially around the heater head 18 between it and the inner partition wall 14.

The only other connection between the fuel nozzle 40 and the main structure or housing 12 are a set of annular soft bellows 46 and 48. Bellow 46 is positioned between annular flange 50 on the nozzle 40 and the partition wall bracket 51. Bellow 48 is mounted on the housing 12 via mounting bracket 52 and engages the fuel nozzle 40 at annular flange 50. The bellows 46 and 48 merely act as a seal between the fuel nozzle 40 and the main housing 12, partition wall 14 and perhaps the loose insulating material 56, therebetween.

By the foregoing arrangement, a substantial force may be applied to the liner 24 with the spring 44 and bellows 46, 48 allow axial thermal movement of the liner 24 as it is necessary. In addition, since springs are typically poor transmitters of high frequency vibrations, the liner 24 is isolated from external pertubrances or vibrations transmitted from the main structure 12.

Figure 2:
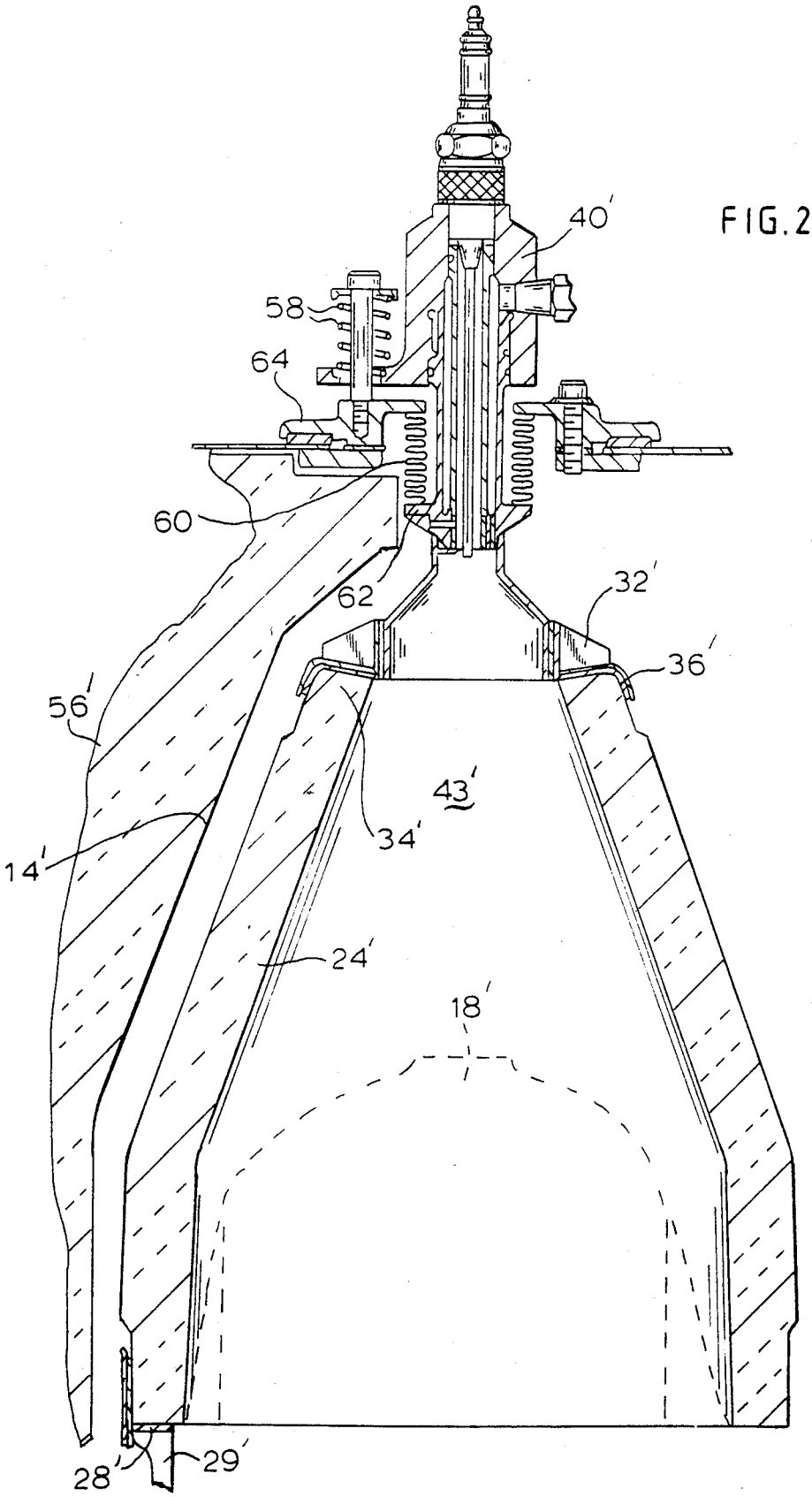
FIG. 2 is a partial sectional view of another embodiment of an external heat system, incorporating the teachings of the present invention.
Figure 3:
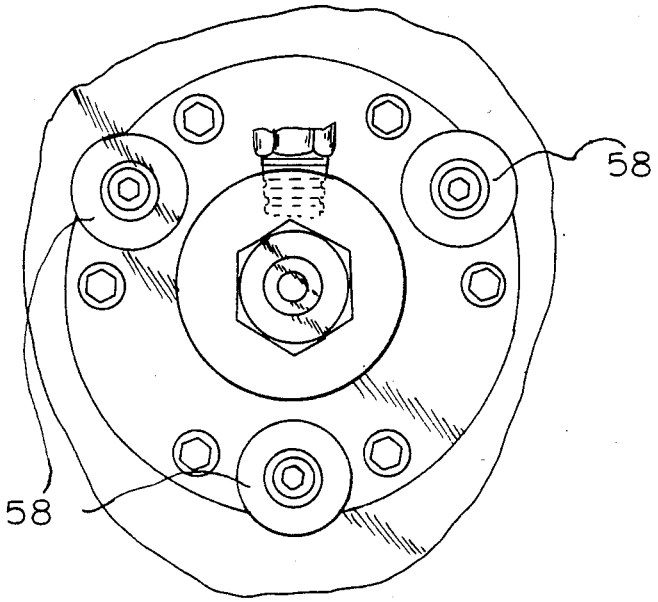
FIG. 3 is a top plan partial view of the mounting arrangement shown in FIG. 2.

Turning now to the second embodiment shown in FIGS. 2 and 3, like parts will be similarly numbered with however a prime "′". This embodiment differs from the last as to the coupling of the ceramic liner 24′ and fuel nozzle 40′ to the housing 12′. In this regard rather than a single spring about the nozzle, this arrangement provides for coupling the nozzle 40′ to the housing 12′ by way of a plurality (three shown) of compression springs 58. These springs 58 similarly apply an axial force on the liner 24′ through the fuel nozzle 40′, cup 32′ and gasket 36′ which bias it downward into gasket 28′ and ring 29′.

The remaining connection between the fuel nozzle 40′ and the housing 12′ is an annular soft bellow 60 which is positioned between annular flange 62 on nozzle 40′ and mounting bracket 64 on the housing 12′. Bellow 60 act merely as a seal between the fuel nozzle 40′, housing 12′, and partition wall 14′.

Thus, by the aforenoted invention, its objects and advantages are realized, and although preferred embodiments have been disclosed and described in detail herein, its scope should not be limited thereby, rather, its scope should be determined by that of the appended claims.

What is claimed is:

1. In an external combustion engine such as a Stirling engine and the like, having an external heat system housing in which is defined a heater space, a hollow liner formed of a ceramic material disposed in said heater space and defining a combustion chamber, and biasing means coupled to a first end of said liner and coupled with the housing so as to maintain said liner in the heater space while dampening transmission of vibrations in the housing to the liner.

2. The invention in accordance with claim 1 which includes fuel nozzle assembly coupled with a first end of said liner and wherein said biasing means includes at least one spring member coupling said fuel nozzle assembly and said housing.

3. The invention in accordance with claim 2 which includes sealing means in the form of bellows disposed between said housing and said fuel nozzle assembly.

4. The invention in accordance with claim 3 which includes a heater head partially disposed in the heater space; said liner includes a second end positioned circumferentially about said heater head.

5. The invention in accordance with claim 4 wherein said second end is biased axially by said biasing means into engagement with a flange means disposed about a heater head.

6. The invention in accordance with claim 5 which includes compliant gasket between said second end and said flange means.

7. The invention in accordance with claim 6 wherein said fuel nozzle assembly includes cap means having an annular flange, with said first end engageable with and disposed within said annular flange.

8. The invention in accordance with claim 7 which includes a compliant gasket between said first end and said annular flange.

9. The invention in accordance with claim 2 wherein said fuel nozzle assembly includes cap means having an annular flange, with said first end engageable with and disposed within said annular flange.

10. The invention in accordance with claim 9 which includes a compliant gasket between said first end and said annular flange.

11. The invention in accordance with claim 2 wherein said biasing means includes at least three spring members positioned equi-distant about said fuel nozzle assembly, coupling said fuel nozzle assembly to the housing.

12. The invention in accordance with claim 2 wherein said spring means is axially positioned about said fuel nozzle assembly.

* * * * *